US006585357B1

(12) United States Patent
Nishimura

(10) Patent No.: US 6,585,357 B1
(45) Date of Patent: Jul. 1, 2003

(54) INK JET HEAD

(75) Inventor: Shigeharu Nishimura, Chiba (JP)

(73) Assignee: Seiko Instruments Inc. (JP)

( * ) Notice: Subject to any disclaimer, the term of this patent is extended or adjusted under 35 U.S.C. 154(b) by 192 days.

(21) Appl. No.: 09/712,575

(22) Filed: Nov. 14, 2000

(30) Foreign Application Priority Data

Nov. 25, 1999 (JP) ..... 11-334704

(51) Int. Cl.[7] ..... B41J 2/045
(52) U.S. Cl. ..... 347/68
(58) Field of Search ..... 347/68, 29, 33, 347/44, 47

(56) References Cited

U.S. PATENT DOCUMENTS 5,548,894 A 8/1996 Muto ..... 29/890.1
5,563,641 A * 10/1996 Plesinger ..... 347/47

FOREIGN PATENT DOCUMENTS

EP 0383019 8/1990
EP 0703082 3/1996

OTHER PUBLICATIONS

Patent Abstracts of Japan, vol. 2000, No. 02, Feb. 29, 2000, publication No. 11320871, publication date Nov. 24, 1999.
Patent Abstracts of Japan, vol. 015, No. 334 (E–1104), Aug. 26, 1991, publication No. 03127489, publication date May 30, 1991.
Patent Abstracts of Japan, vol. 018, No. 098 (M–1562), Feb. 17, 1994, publication No. 05301343, publication date Nov. 16, 1993.

* cited by examiner

*Primary Examiner*—Judy Nguyen
(74) *Attorney, Agent, or Firm*—Adams & Wilks

(57) ABSTRACT

An ink jet head has a first cover member having an ink chamber for storing ink. A piezoelectric body is connected to the first cover member and has channels disposed in communication with the ink chamber of the cover member for receiving ink. A plate member has a first surface connected to the first cover member and the piezoelectric body, a second surface disposed opposite the first surface, an outer peripheral edge, and openings extending through the first and second surfaces and disposed in communication with a respective one of the channels of the piezoelectric body. A second cover member has a first surface, a second surface disposed opposite the first surface, and an opening extending from the first surface to the second surface. The plate member is disposed in the opening so that the second cover member surrounds at least a portion of the outer peripheral edge of the plate member. Electrodes are connected to the piezoelectric body and are driven by a voltage signal to deform a portion of the piezoelectric body to vary a volume of each of the channels to thereby eject ink from the channels through the openings of the plate member.

24 Claims, 7 Drawing Sheets

INK JET HEAD

BACKGROUND OF THE INVENTION

1. Field of the Invention

The present invention relates to an ink jet head mounted on an ink jet recording apparatus applied to, for example, a printer or a facsimile machine.

2. Description of the Related Art

Conventionally, an ink jet recording apparatus for recording letters or images on a recording medium using a recording head for expelling ink from a plurality of nozzles is known. In such an ink jet recording apparatus, the recording head opposed to the recording medium is provided in a head holder, and the head holder is mounted on a carriage to scan the recording medium in a direction orthogonal to the direction of conveyance of the recording medium.

FIG. 6 is an exploded perspective view showing the main part of an example of such conventional recording head. FIG. 7A is a side sectional view and FIG. 7B is a frontal sectional view taken along line 7B—7B in FIG. 7A showing the main part of the conventional recording head. As shown in FIGS. 6 and 7, a plurality of channels 102 are provided side by side in an actuator plate 101 formed of piezoelectric ceramic in its width direction. The channels 102 are separated from one another by side walls 103. One end portion of the channels 102 in the longitudinal direction extends to one end face of the actuator plate 101, while the other end portion does not extend to the other end face, with the depth being gradually decreased. An electrode 105 for applying a drive voltage is formed on the surface of the opening side of both side walls 103 and 103 of each channel 102 over the longitudinal direction.

A cover plate 107 is joined by an adhesive 109 to the opening side of the channels 102 in the actuator plate 101. The gap between the shallow portions of the rear end portion of the channels 102 in the actuator plate 101 and the cover plate 107 is sealed with sealant 110. The cover plate 107 has a common ink chamber 111 which is a concave portion communicating with the shallow, other end portion of the channels 102, and an ink supply port 112 piercing from the bottom portion of the common ink chamber 111 in the opposite direction from the channels 102. An ink flow path 114 of a flow path block 113 communicates with and opens to the ink supply port 112. Further, a filter 116 is attached to an end portion of the ink flow path 114 of the flow path block 113 on the side of the ink supply port 112.

A nozzle plate 115 is affixed and joined by an adhesive to an end face where the channels 102 of the joined body of the actuator plate 101 and the cover plate 107 are open. The width of the nozzle plate 115 is larger than the width of the end face of the joined body and the length of the nozzle plate 115 is larger than the length of the end face of the joined body. Nozzle openings 117 are formed in the nozzle plate 115 at positions opposed to the channels 102, respectively. Further, as shown in FIGS. 7A, 7B, a nozzle plate cover 118 is fixed by the adhesive to the rear surface of the nozzle plate 115 so as to cover the outer peripheral surface of an end portion of the joined body of the actuator plate 101 and the cover plate 107 and to cover the rear surface of the nozzle plate 115.

It is to be noted that a wiring board 120 is fixedly attached to a surface of the actuator plate 101 which is opposite to the side of the nozzle plate 115 and opposite to the side of the cover plate 107. Wirings 122 connected to the electrodes 105, respectively, using bonding wires 121, a flexible substrate, or the like are formed on the wiring board 120, such that drive voltage can be applied to the electrodes 105 via the wirings 122.

In the recording head described above, the channels 102 are filled with ink from the ink flow path 113 via the ink supply port 112 and the common ink chamber 111. By applying a predetermined drive voltage on side walls 103 on both sides of a predetermined channel 102 via the electrodes 105, the side walls 103 are deformed to change the volume in the predetermined channel 102, which leads to expulsion of ink in the channel 102 from the nozzle opening 117.

For example, as shown in FIG. 8 which is a frontal sectional view showing the main part, in the case where ink is expelled from a nozzle opening 117 corresponding to a channel 102*a*, positive drive voltage is applied to electrodes 105*a* and 105*b* in the channel 102*a* while electrodes 105*c* and 105*d* opposed to the electrodes 105*a* and 105*b*, respectively, are grounded. By this, drive electric field toward the channel 102*a* acts on the side walls 103*a* and 103*b*. When this is orthogonal to the direction of polarization of the actuator plate 101 formed of piezoelectric ceramic, due to a piezoelectric thickness sliding effect, the side walls 103*a* and 103*b* are deformed to be warped toward the channel 102, the volume in the channel 102 is decreased to increase the pressure, and ink is expelled from the nozzle opening 117.

Further, in such a recording head, a water-repellent film having water repellency is provided on the surface of the nozzle plate 115 which is opposed to a printed material for the purpose of preventing a head from getting dirty due to attachment of ink, preventing clogging of the nozzle openings 117, and the like. Further, the head end face is cleaned at predetermined regular time intervals or at a desired time. The cleaning is typically carried out by wiping out the face of the nozzle plate 115 which is opposed to a printed material with a wiper formed of, for example, rubber which has a relatively high hardness (Hs 40–50) and does not swell.

However, in the structure of the recording head described in the above, the whole thickness of the nozzle plate 115 is exposed. Therefore, there is a problem that, when the nozzle plate 115 is wiped out with a wiper, or, when a printed material (printed paper) is not properly fed and is jammed to be crumpled, force in the direction of peeling the nozzle plate 115 off the wiper or the printed material acts on the exposed nozzle plate 115, and thus, the nozzle plate 115 is peeled off the end face of the joined body of the actuator plate 101 and the cover plate 107.

SUMMARY OF THE INVENTION

The present invention is made in view of these circumstances, and an object of the present invention is to provide an ink jet head in which a nozzle plate does not peel off the end face of a joined body of an actuator plate and a cover plate and the durability of which is expected to be improved.

In order to solve the above problem, according to a first aspect of the present invention, an ink jet head comprises: an actuator plate formed of piezoelectric ceramic with a plurality of channels formed therein, the channels opening to one surface and to one end face; a cover plate with a common ink chamber and an ink supply port formed therein, the common ink chamber being joined to the one surface of the actuator plate to seal a part of openings of the channels and to communicate with the channels, and the ink supply port piercing from the bottom portion of the common ink chamber in a direction opposite to the channels; a flow path block provided with a broad ink flow path, the inlet side thereof communicating with a narrow opening in proximity to an ink inflow port and the outlet side thereof communicating with the ink supply port; and a nozzle plate sealing the one end face of the actuator plate and having nozzle openings corresponding to the channels, respectively, the ink jet head expelling ink filled in the channels from the nozzle openings by applying drive voltage to electrodes provided on side walls of the channels and thereby changing the volume in the channels, and is characterized by comprising a nozzle plate cover joined to an outer side surface of the joined body of the actuator plate and the cover plate for surrounding the nozzle plate to protect the nozzle plate, and is characterized in that a surface of the nozzle plate which is opposed to a printed material is flush with a surface of the nozzle plate cover which is opposed to a printed material or protrudes from the surface of the nozzle plate cover in a predetermined range of height.

By structuring the ink jet head in this way, the whole thickness of the nozzle plate is not exposed. Therefore, when the nozzle plate is wiped out with a wiper, or, when a printed material (printed paper) is not properly fed and is jammed to be crumpled, force in the direction of peeling the nozzle plate off the wiper or the printed material does not greatly act on a greatly exposed edge, and thus, the peeling of the nozzle plate off the end face of the joined body of the actuator plate and the cover plate is prevented and the durability can be expected to be improved.

According to a second aspect of the present invention, an ink jet head of the above first aspect of the invention is characterized in that the nozzle plate is formed so as to protrude from the outer edge of a front end of the joined body of the actuator plate and the cover plate, and the nozzle plate cover is shaped so as to surround the outer periphery and the rear surface of the nozzle plate.

By structuring the ink jet head in this way, action and effects similar to those of the above first aspect of the invention can be attained.

According to a third aspect of the present invention, an ink jet head of the above first or second aspect of the invention is characterized in that the surface of the nozzle plate which is opposed to a printed material protrudes from the surface of the nozzle plate cover which is opposed to a printed material by 0 $\mu$m or more and half of the thickness of the nozzle plate or less.

When the surface of the nozzle plate which is opposed to a sprinted material protrudes from the surface of the nozzle plate cover which is opposed to a printed material by less than 0 $\mu$m (a negative value, that is, when the surface of the nozzle plate which is opposed to a printed material receding with respect to the surface of the nozzle plate cover which is opposed to a printed material, ink remains in, for example, corner portions of the outer edges of the nozzle plate, and the wiping of the nozzle plate with the wiper is not carried out satisfactorily.

When the surface of the nozzle plate which is opposed to a printed material protrudes from the surface of the nozzle plate cover which is opposed to a printed material by more than half of the thickness of the nozzle plate, the peripheral surface of the nozzle plate is exposed more greatly than the nozzle plate cover for protection. When the nozzle plate is wiped out with a wiper, or, when a printed material (printed paper) is not properly fed and is jammed to be crumpled, force in the direction of peeling the nozzle plate off the wiper or the printed material acts on the exposed edges and the side surface of the nozzle plate, and thus, the nozzle plate is liable to peel off the end face of the joined body of the actuator plate and the cover plate.

BRIEF DESCRIPTION OF THE DRAWINGS

For a more better understanding of the present invention, reference is made of a detailed description to be read in conjunction with the accompanying drawings, in which:

FIGS. 1A, 1B are exploded perspective views of an embodiment of an ink jet head according to the present invention, in which FIG. 1A is an overall view, and FIG. 1B is a partially broken exploded perspective view;

FIGS. 7A, 7B are sectional views schematically showing the main part of the conventional recording head, in which FIG. 7A is a side sectional view, and FIG. 7B is a frontal sectional view taken along the line 7B—7B in FIG. 7A.

DETAILED DESCRIPTION OF THE PREFERRED EMBODIMENTS

Though an embodiment of the present invention is described in the following with reference to the attached drawings, the present invention is not limited thereto.

Figure 1A:
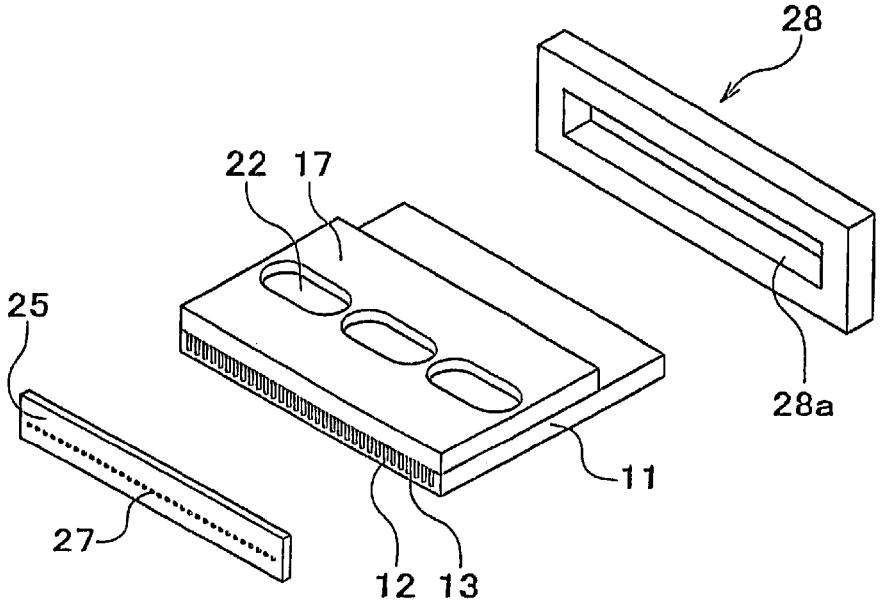
Figure 1B:
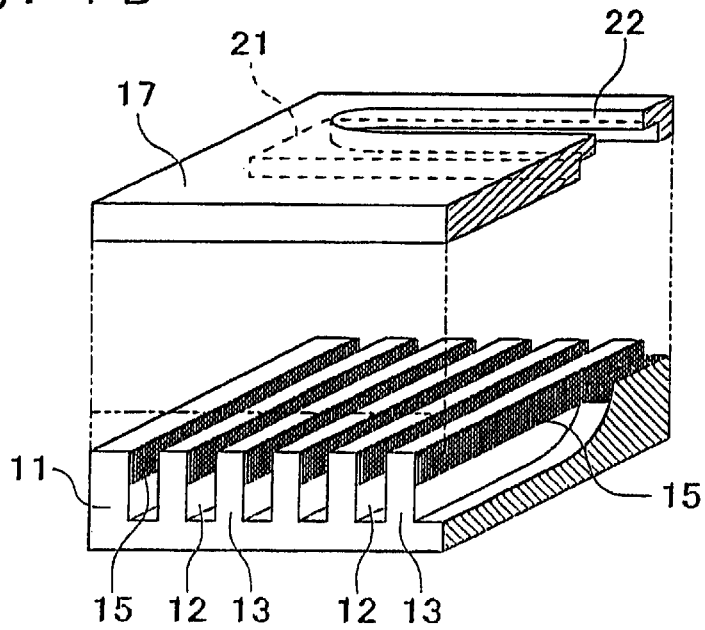
Figure 2:
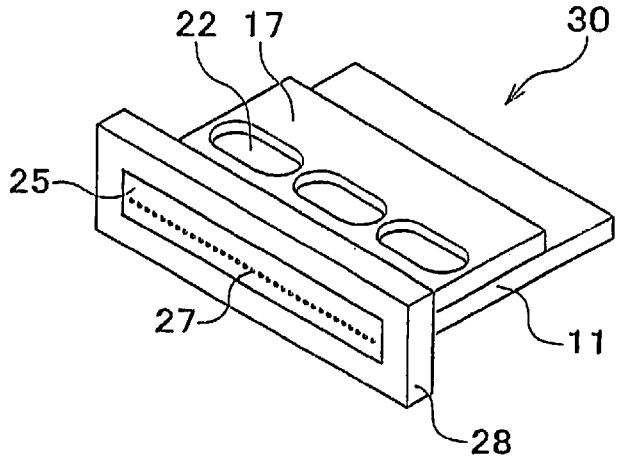
FIG. 2 is a perspective view of the embodiment when assembled.
Figure 3:
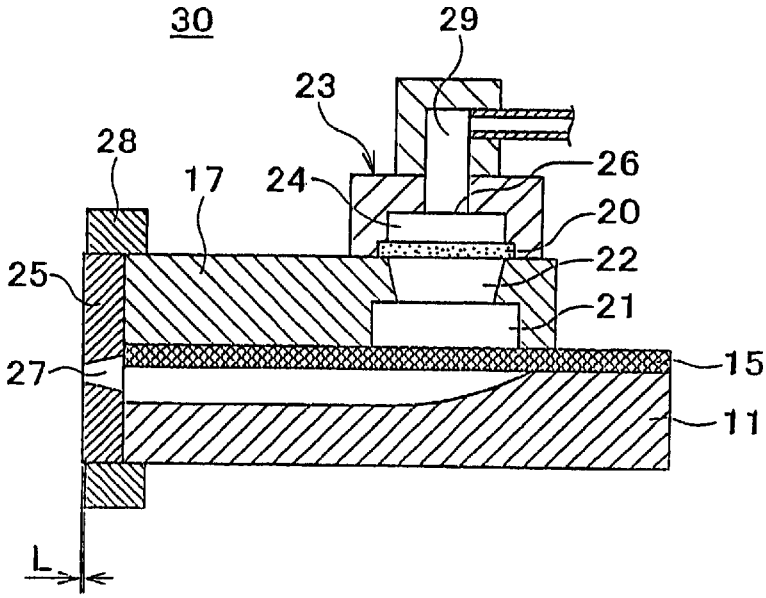
FIG. 3 is a longitudinal sectional view taken along the line 3—3 of FIG. 2.

FIGS. 1A, 1B are exploded perspective views of an embodiment of an ink jet head according to the present invention. FIG. 1A is an overall view, FIG. 1B is a partially broken exploded perspective view, FIG. 2 is a perspective view of the embodiment when assembled, and FIG. 3 is a longitudinal sectional view taken along the line 3—3 of FIG. 2.

As shown in FIGS. 1A, 1B, a plurality of channels 12 are provided side by side in a width direction of a piezoelectric body which comprises an actuator plate 11 formed of piezoelectric material such as a ceramic. The channels 12 are separated from one another by side walls 13.

One end portion of the channels 12 in the longitudinal direction is provided to extend to an end face of the actuator plate 11, while the other end portion is formed so as not to extend to the other end face, with the depth being gradually decreased. An electrode 15 for applying a drive voltage is formed on the surface of the opening side of both side walls 13 and 13 of each channel 12 over the longitudinal direction.

A first cover member or plate 17 is joined by an adhesive to the opening side of the channels 12 in the actuator plate 11. The cover plate 17 has a common ink chamber 21 which is a concave portion communicating with the shallow, other end portion of the channels 12, and an ink supply port 22 piercing from the bottom portion of the common ink chamber 21 in the opposite direction from the channels 12. An ink flow path 24 of a block member or flow path block 23 communicates with and opens to the ink supply port 22. The flow path block 23 has a built-in ink inflow port 29 for receiving ink conveyed from an ink cartridge which is not shown in the figures via a tube which is not shown in the figures, and has the built-in broad ink flow path 24 communicating with a narrow opening 26 on the outlet side of the ink inflow port 29, with the outlet side of the ink flow path 24 communicating with the ink supply port 22. Further, a filter 20 for removing a foreign matter in the ink is attached to an end portion of the ink flow path 24 of the flow path block 23 on the side of the ink supply port 22.

It is to be noted that, though the cover plate 17 can be formed of a ceramic plate, a metal plate, or the like, taking into consideration of deformation after joining to the actuator plate 11 formed of piezoelectric ceramic, it is preferable to use a ceramic plate having similar thermal expansion, particularly a piezoelectric ceramic plate.

A plate member or nozzle plate 25 is affixed and joined by an adhesive to an end face where the channels 12 of the joined body of the actuator plate 11 and the cover plate 17 are open. Nozzle openings 27 are formed in the nozzle plate 25 at positions corresponding to the channels 12, respectively.

In the present embodiment, the nozzle plate 25 is formed to be a little larger than the area of the end face where the channels 12 of the joined body of the actuator plate 11 and the cover plate 17 are open. The nozzle plate 25 is a polyimide film or the like with the nozzle openings 27 formed therein having the diameter of, for example, 25 $\mu$m using, for example, an excimer laser system. Further, though not shown in the figures, a water-repellent film having water repellency is provided on the surface of the nozzle plate 25 which is opposed to a printed material for the purpose of preventing attachment of ink and the like.

In the present embodiment, a second cover member or nozzle plate cover 28 having an opening 28*a* which can be fit to the nozzle plate 25 is disposed on an outer side surface of the nozzle plate 25 and on the periphery of the end portion where the channels 12 of the joined body of the actuator plate 11 and the cover plate 17 are open, and is joined by the adhesive to a part of the rear surface and the side surface of the nozzle plate 25 and to the outer side surface of the joined body of the actuator plate 11 and the cover plate 17. The nozzle plate cover 28 is for protecting the nozzle plate 25 from the situation that, when the nozzle plate 25 is wiped out with a wiper, or, when a printed material (printed paper) is not properly fed and is jammed to be crumpled, force in the direction of peeling the nozzle plate 25 off the wiper or the printed material acts and the nozzle plate 25 is peeled off the end face of the joined body of the actuator plate 11 and the cover plate 17. The nozzle plate cover 28 is attached such that the surface of the nozzle plate 25 which is opposed to a printed material is flush with the surface of the nozzle plate cover 28 which is opposed to a printed material or protrudes from the surface of the nozzle plate cover by a predetermined amount L.

The protrusion amount L of the nozzle plate 25 in relation to the nozzle plate cover 28 is preferably 0 $\mu$m or larger and is half of the thickness of the nozzle plate or smaller. For example, if the thickness of the nozzle plate is 50 $\mu$m, the protrusion amount L is preferably 25 $\mu$m or smaller. If the protrusion amount L is a negative value less than 0 $\mu$m, the wiping of the nozzle plate 25 with the wiper is not carried out satisfactorily, which is not preferable. Further, when L is larger than half of the thickness of the nozzle plate, the side surface of the nozzle plate 25 is exposed more greatly than the nozzle plate cover 28 for protection. When the nozzle plate 25 is wiped out with a wiper, or, when a printed material (printed paper) is not properly fed and is jammed to be crumpled, force in the direction of peeling the nozzle plate off the wiper or the printed material acts on the exposed edge 25*c* and the side surface, and thus, the nozzle plate 25 is liable to peel off the end face of the joined body of the actuator plate 11 and the cover plate 17, which is not preferable.

Since the nozzle plate cover 28 and the nozzle plate 25 are positioned with a relatively high accuracy in this way, it is preferable that the nozzle plate cover 28 is formed of a material having a high rigidity, for example, stainless steel, aluminum, hard plastic, or the like.

It is to be noted that, though the nozzle plate cover 28 is preferably formed in one piece as shown in the figures, it may be structured with two pieces integrally connected together, for example.

In the present embodiment structured as above, the end portion of the nozzle plate 25 on the side opposite to the surface opposed to a printed material is surrounded by the nozzle plate cover 28. Therefore, a situation is prevented in which, when the nozzle plate 25 is wiped out with a wiper, or, when a printed material (printed paper) is not properly fed and is jammed to be crumpled, force in the direction of peeling the nozzle plate 25 off the wiper or the printed material acts and the nozzle plate 25 is peeled off the end face of the joined body of the actuator plate 11 and the cover plate 17. This improves the durability.

An ink jet head 30 (see FIG. 2) structured in this way is formed by, first, joining the actuator plate 11 formed of piezoelectric ceramic and the cover plate 17 using the adhesive, then joining the nozzle plate 25 to the end face of the joined body using the adhesive, and, at the same time, fitting and adhering the nozzle plate cover 28 onto the outer side surface of the nozzle plate 25 and onto the joined body of the actuator plate 11 and the cover plate 17.

Figure 4:
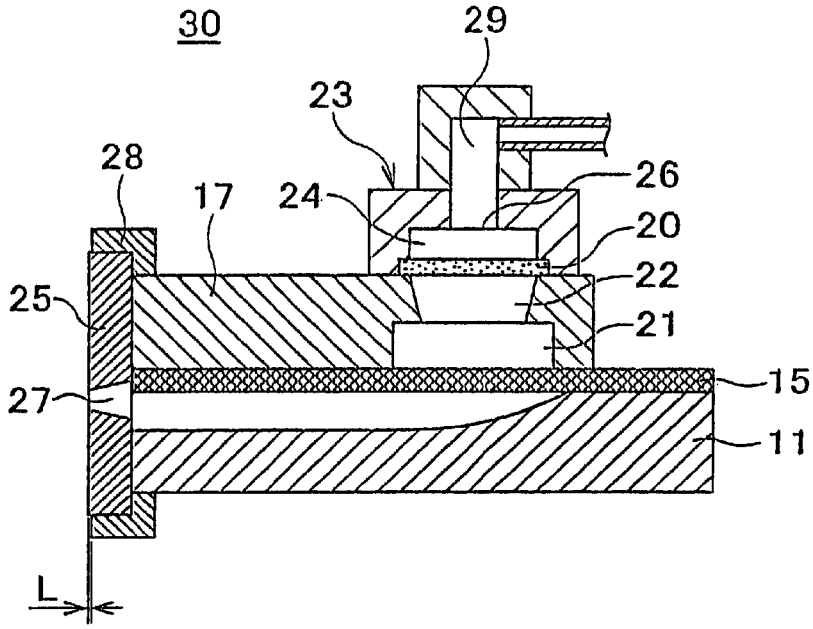
FIG. 4 is a longitudinal sectional side view of a second embodiment of an ink jet head according to the present invention.

FIG. 4 is a longitudinal sectional side showing another embodiment of an ink jet head according to the present invention.

In the present embodiment, as shown in FIG. 4, the nozzle plate 25 is formed such that its width is larger than the width of the end face of the joined body of the actuator plate 11 and the cover plate 17. Also, although not shown in the figures, the nozzle plate 25 is formed such that its length is larger than the length of the end face of the joined body of the actuator plate 11 and the cover plate 17. The nozzle plate cover 28 is formed so as to surround the peripheral surface of the nozzle plate 25 and so as to surround the outer periphery and the rear surface of the nozzle plate. The base portion of the nozzle plate cover 28 is joined to the outer peripheral surface of the end portion of the joined body of the actuator plate 11 and the cover plate.17.

The protrusion amount L of the nozzle plate 25 in relation to the nozzle plate cover 28 is preferably 0 $\mu$m or larger and half of the thickness of the nozzle plate or smaller, the reason for which is the same as that described in the above embodiment.

It is to be noted that, when the nozzle plate cover 28 is fitted and adhered, it is necessary to position both the surface of the nozzle plate 25 and the surface of the nozzle plate cover 28. Though the method to attain this is not specifically limited, in the present embodiment, the positioning was carried out as described in the following.

Figure 5A:
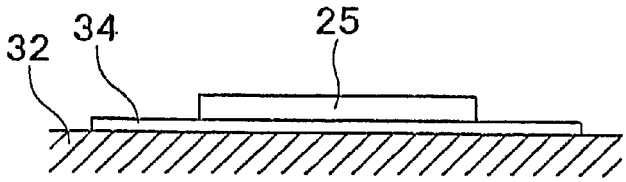
FIGS. 5A–5D are sectional views showing a schematic manufacturing process of the second embodiment of an ink jet head according to the present invention.

(1) As shown in FIG. 5A, a heat-resistant tape 34 is affixed onto a glass plate 32, and then, the nozzle plate 25 is mounted thereon.

Figure 5B:
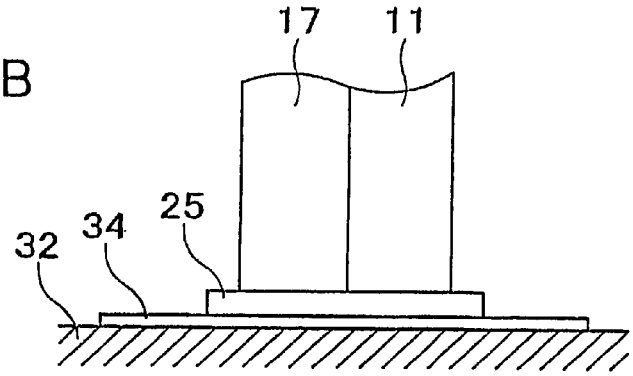

(2) As shown in FIG. 5B, the end face of the joined body of the actuator plate 11 and the cover plate 17 is positioned and mounted on the nozzle plate 25.

Figure 5C:
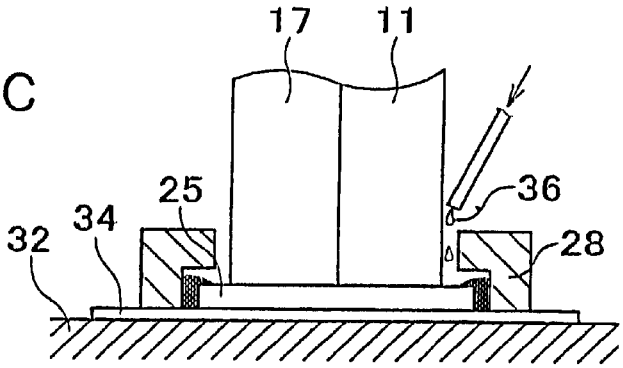

(3) As shown in FIG. 5C, the nozzle plate cover 28 is set such that the space between itself and the nozzle plate 25 and the space between itself and the joined body of the actuator plate 11 and the cover plate 17 are well-balanced. The space between the nozzle plate 25 and the nozzle plate cover 28 and the space between the joined body of the actuator plate 11 and the cover plate 17 and the nozzle plate cover 28 are filled with thermosetting adhesive 36, which is then heated to be cured.

Figure 5D:
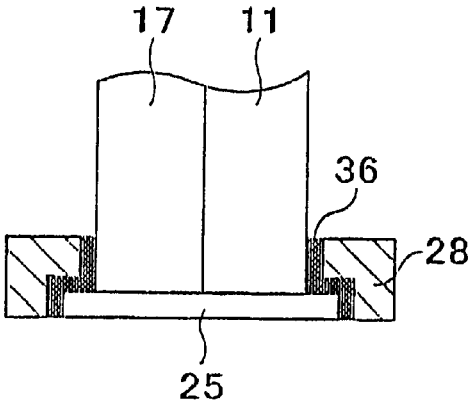
Figure 6:
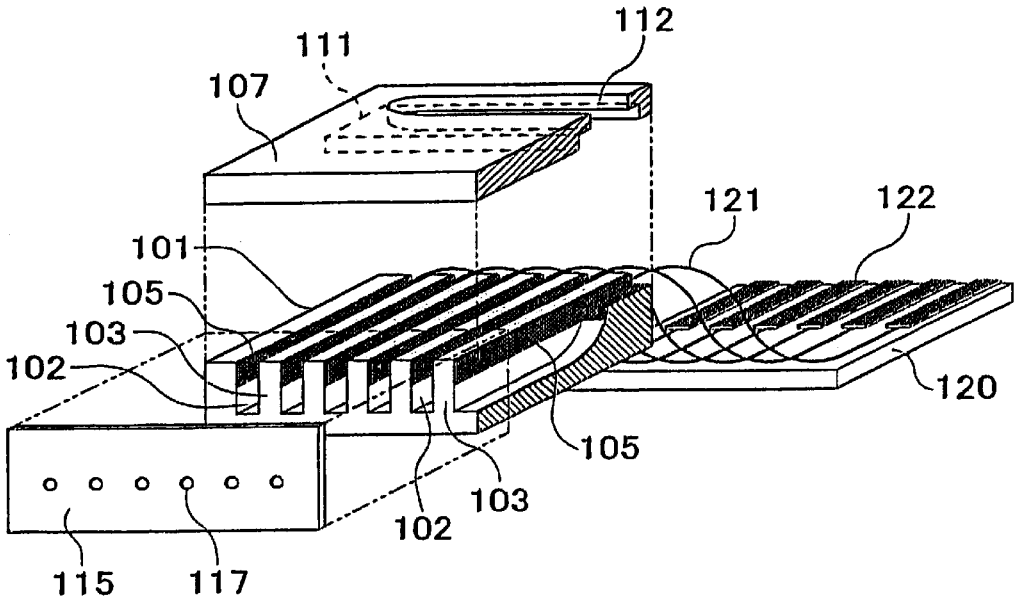
Fig. 6 PRIOR ART
FIG. 6 is an exploded perspective view schematically showing the main part of a conventional recording head.
Figure 7A:
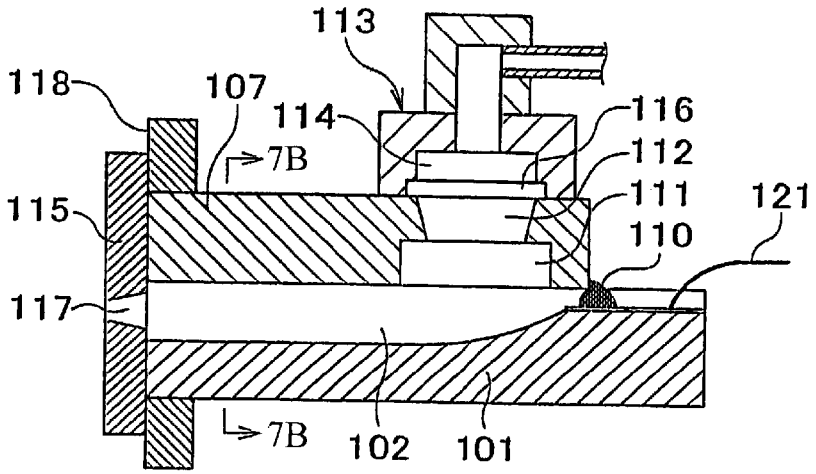
Fig. 7A PRIOR ART
Figure 7B:
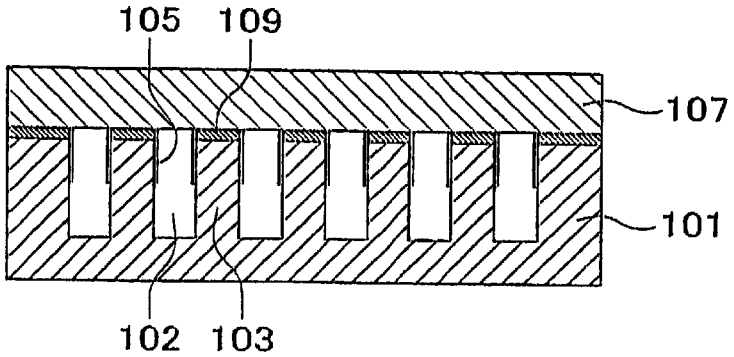
Fig. 7B PRIOR ART
Figure 8:
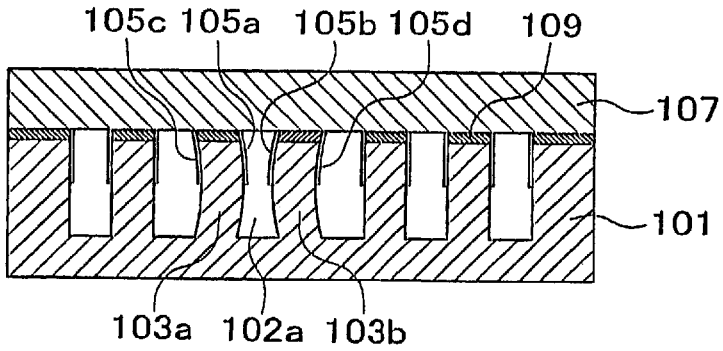
FIG. 8 is frontal sectional view showing the main part of the conventional recording head and of the ink jet head according to the present invention, and illustrating a driving condition thereof.

(4) As shown in FIG. 5D, the heat-resistant tape 34 is peeled off the integrally formed ink jet head 30. According to the method described in the above, the surface of the nozzle plate 25 and the surface of the nozzle plate cover 28 can be positioned to be flush with each other. Further, by using the glass plate, unevenness when the adhesive is filled can be eliminated.

It is to be noted that, since the principle of driving and the like of the embodiment of an ink jet head described in the above are the same as those described with respect to prior art, the description thereof is omitted herein.

As described in the above, an ink jet head according to the present invention comprises a nozzle plate cover joined to the outer side surface of a joined body of an actuator plate and a cover plate and surrounding a nozzle plate to protect the nozzle plate, and is structured such that it is characterized in that the surface of the nozzle plate which is opposed to a printed material is flush with the surface of the nozzle plate cover which is opposed to a printed material or protrudes from the surface of the nozzle plate cover by half of the thickness of the nozzle plate or less. Therefore, the peripheral surface of the nozzle plate is exposed not much, and thus, when the nozzle plate is wiped out with a wiper, or, when a printed material (printed paper) is not properly fed and is jammed to be crumpled, force in the direction of peeling the nozzle plate off the wiper or the printed material does not act on a greatly exposed edge and the outer peripheral surface, and thus, the peeling of the nozzle plate off the end face of the joined body of the actuator plate and the cover plate is prevented and the durability can be expected to be improved.

What is claimed is:

1. An ink jet head comprising:

an actuator plate made of a piezoelectric material and having an upper surface, a side surface, and a plurality of channels each having a pair of side walls;

a cover plate having an ink chamber and an ink supply port disposed in communication with the ink chamber, the cover plate being connected to the upper surface of the actuator plate so that the ink chamber is disposed in communication with the channels of the actuator plate;

a flow path block having an ink flow port for receiving ink and an ink flow path having an inlet disposed in communication with the ink inflow port and an outlet disposed in communication with the ink supply port of the cover plate so that ink received by the ink flow port flows into the channels of the actuator plate through the ink flow path and through the ink supply port and the ink chamber of the cover plate;

a nozzle plate having a first surface connected to the side surface of the actuator plate, a second surface disposed opposite the first surface, an outer peripheral edge, and a plurality of nozzle openings each extending through the first and second surfaces and disposed in communication with a respective one of the channels of the actuator plate;

a plurality of electrodes connected to the side walls of the channels of the actuator plate and driven by a voltage signal to deform the side walls to vary the volume in the channels to thereby eject ink from the channels through the nozzle openings; and a nozzle plate cover connected to the actuator plate and the cover plate and disposed over and surrounding at least a portion of the outer peripheral edge of the nozzle plate, the nozzle plate protruding from a surface of the nozzle plate cover in a direction away from the channels of the actuator plate and by an amount of up to one-half a thickness of the nozzle plate.

2. An ink jet head comprising:

an actuator plate made of a piezoelectric material and having an upper surface, a side surface, and a plurality of channels each having a pair of side walls;

a cover plate having an ink chamber and an ink supply port disposed in communication with the ink chamber, the cover plate being connected to the upper surface of the actuator plate so that the ink chamber is disposed in communication with the channels of the actuator plate;

a flow path block having an ink flow port for receiving ink and an ink flow path having an inlet disposed in communication with the ink inflow port and an outlet disposed in communication with the ink supply port of the cover plate so that ink received by the ink flow port flows into the channels of the actuator plate through the ink flow path and through the ink supply port and the ink chamber of the cover plate;

a nozzle plate having a first surface connected to the side surface of the actuator plate, a second surface disposed opposite the first surface, an outer peripheral edge, and a plurality of nozzle openings each extending through the first and second surfaces and disposed in communication with a respective one of the channels of the actuator plate;

a plurality of electrodes connected to the side walls of the channels of the actuator plate and driven by a voltage signal to deform the side walls to vary the volume in the channels to thereby eject ink from the channels through the nozzle openings; and a nozzle plate cover connected to the actuator plate and the cover plate and disposed over and surrounding at least a portion of the outer peripheral edge of the nozzle plate, the nozzle plate cover having a front surface facing in a direction away from the channels of the actuator plate and a rear surface, and the front surface of the nozzle plate cover being flush with the second surface of the nozzle plate.

3. An ink jet head according to claim 2; wherein the piezoelectric material comprises a piezoelectric ceramic material.

4. An ink jet head comprising:

an actuator plate made of a piezoelectric material and having an upper surface, a side surface, and a plurality of channels each having a pair of side walls;

a cover plate having an ink chamber and an ink supply port disposed in communication with the ink chamber, the cover plate being connected to the upper surface of the actuator plate so that the ink chamber is disposed in communication with the channels of the actuator plate;

a flow path block having an ink flow port for receiving ink and an ink flow path having an inlet disposed in communication with the ink inflow port and an outlet disposed in communication with the ink supply port of the cover plate so that ink received by the ink flow port flows into the channels of the actuator plate through the ink flow path and through the ink supply port and the ink chamber of the cover plate;

a nozzle plate having a first surface connected to the side surface of the actuator plate, a second surface disposed opposite the first surface, an outer peripheral edge, and a plurality of nozzle openings each extending through the first and second surfaces and disposed in communication with a respective one of the channels of the actuator plate;

a plurality of electrodes connected to the side walls of the channels of the actuator plate and driven by a voltage signal to deform the side walls to vary the volume in the channels to thereby eject ink from the channels through the nozzle openings; and a nozzle plate cover connected to the actuator plate and the cover plate and disposed over and surrounding at least a portion of the outer peripheral edge of the nozzle plate, the nozzle plate cover having a front surface facing in a direction away from the channels of the actuator plate and a rear surface, and the second surface of the nozzle plate protruding from the front surface of the nozzle plate cover.

5. An ink jet head according to claim 4; wherein the second surface of the nozzle plate protrudes from the front surface of the nozzle plate cover by an amount of up to one-half a distance between the first and second surfaces of the nozzle plate.

6. An ink jet head according to claim 4; wherein the piezoelectric material comprises a piezoelectric ceramic material.

7. An ink jet head comprising: a first cover member having an ink chamber for storing ink; a piezoelectric body connected to the first cover member and having a plurality of channels disposed in communication with the ink chamber of the cover member for receiving ink; a plate member having a first surface connected to the first cover member and the piezoelectric body, a second surface disposed opposite the first surface, an outer peripheral edge, and a plurality of openings each extending through the first and second surfaces and disposed in communication with a respective one of the channels of the piezoelectric body; a second cover member having a first surface, a second surface disposed opposite the first surface, and an opening extending from the first surface to the second surface and in which is disposed the plate member so that the second cover member surrounds at least a portion of the outer peripheral edge of the plate member, the second surface of the plate member being flush with the first surface of the second cover member; and a plurality of electrodes connected to the piezoelectric body and driven by a voltage signal to deform a portion of the piezoelectric body to vary a volume of each of the channels to thereby eject ink from the channels through the openings of the plate member.

8. An ink jet head according to claim 7; wherein the second cover member is disposed directly in contact with the outer peripheral surface of the plate member.

9. An ink jet head according to claim 7; wherein the second cover member is connected to the first surface of the plate member.

10. An ink jet head according to claim 7; wherein the second cover member is disposed in contact with the plate member, the first cover member and the piezoelectric body.

11. An ink jet head according to claim 10; wherein the second cover member is disposed in contact with the first surface of the plate member.

12. An ink jet head according to claim 7; wherein the piezoelectric body comprises a piezoelectric ceramic member.

13. An ink jet head according to claim 12; wherein the first cover member comprises a piezoelectric ceramic plate.

14. An ink jet head according to claim 7; further comprising a block member having an ink flow port for charging ink, and an ink flow path disposed in communication with the ink flow port for directing ink into the ink chamber of the first cover member.

15. An ink jet head according to claim 14; wherein the second surface of the plate member protrudes from the first surface of the second cover member by an amount equal to or less than one-half the thickness of the plate member.

16. An ink jet head comprising: a first cover member having an ink chamber for storing ink; a piezoelectric body connected to the first cover member and having a plurality of channels disposed in communication with the ink chamber of the cover member for receiving ink; a plate member having a first surface connected to the first cover member and the piezoelectric body, a second surface disposed opposite the first surface, an outer peripheral edge, and a plurality of openings each extending through the first and second surfaces and disposed in communication with a respective one of the channels of the piezoelectric body; a second cover member having a first surface, a second surface disposed opposite the first surface, and an opening extending from the first surface to the second surface and in which is disposed the plate member so that the second cover member surrounds at least a portion of the outer peripheral edge of the plate member, the second surface of the plate member protruding from the first surface of the second cover member; and a plurality of electrodes connected to the piezoelectric body and driven by a voltage signal to deform a portion of the piezoelectric body to vary a volume of each of the channels to thereby eject ink from the channels through the openings of the plate member.

17. An ink jet head according to claim 16; wherein the second cover member is disposed directly in contact with the outer peripheral surface of the plate member.

18. An ink jet head according to claim 16; wherein the second cover member is connected to the first surface of the plate member.

19. An ink jet head according to claim 16; wherein the second cover member is disposed in contact with the plate member, the first cover member and the piezoelectric body.

20. An ink jet head according to claim 19; wherein the second cover member is disposed in contact with the first surface of the plate member.

21. An ink jet head according to claim 16; wherein the piezoelectric body comprises a piezoelectric ceramic member.

22. An ink jet head according to claim 21; wherein the first cover member comprises a piezoelectric ceramic plate.

23. An ink jet head according to claim 16; further comprising a block member having an ink flow port for charging ink, and an ink flow path disposed in communication with the ink flow port for directing ink into the ink chamber of the first cover member.

24. An ink jet head according to claim 16; wherein the second surface of the plate member protrudes from the first surface of the second cover member by an amount equal to or less than one-half the thickness of the plate member.

* * * * *